US008215049B2

(12) United States Patent
Schuchman

(10) Patent No.: US 8,215,049 B2
(45) Date of Patent: Jul. 10, 2012

(54) VEHICLE GUN STABILIZATION PLATFORM DEVICE

(76) Inventor: Kurt Cameron Schuchman, Jourdanton, TX (US)

( * ) Notice: Subject to any disclaimer, the term of this patent is extended or adjusted under 35 U.S.C. 154(b) by 257 days.

(21) Appl. No.: 12/655,595

(22) Filed: Jan. 4, 2010

(65) Prior Publication Data

US 2010/0199835 A1 Aug. 12, 2010

Related U.S. Application Data

(60) Provisional application No. 61/206,835, filed on Feb. 6, 2009.

(51) Int. Cl.
*F41A 29/00* (2006.01)

(52) U.S. Cl. ..... 42/94; 89/37.04

(58) Field of Classification Search ..... 42/94; 89/37.04, 89/37.03

See application file for complete search history.

(56) References Cited

U.S. PATENT DOCUMENTS 4,937,965 A * 7/1990 Narvaez ..... 42/94
5,330,061 A 7/1994 Geltz
6,243,979 B1 * 6/2001 Seats et al. ..... 42/94
7,066,365 B2 * 6/2006 Brown ..... 224/401
7,325,696 B2 2/2008 Matthew et al.
7,415,790 B1 * 8/2008 Ruhland et al. ..... 42/94
7,536,820 B2 * 5/2009 Wade et al. ..... 42/94
7,676,978 B2 * 3/2010 Marlatt ..... 42/94

* cited by examiner

*Primary Examiner* — J. Woodow Eldred

(57) ABSTRACT

A weapon stabilization platform assembly employing the action of the devices' telescoping tubular horizontal width adjustment attaching to the vertical roll over posts of a recreational off road 4×4, off road UTV, or other utility vehicle or frame vehicle by the nut and bolt compression of two bracket couplings or other attaching appliances fixed at the opposing end of each of the telescoping tubes. In a preferred embodiment, the device comprises a plurality of telescoping tubes being an outer sleeve and an inner sleeve that is sized to permit it to move horizontally in telescopic relationship to the outer sleeve, both sleeves being harbored within an anti-vibration foam cushion, being then sheathed within a protective fabric sleeve. Each tube end connecting by nut and bolt compression to axial end bracket couplings, and the bracket couplings becoming then fixed to the vertical roll over posts of a UTV or other frame by nut and bolt horizontal end compression or other locking attachment device, allowing the military, civilian, or handicapped user a vibration eliminating or reducing horizontal weapon aiming and shooting, camera or other device rest.

5 Claims, 6 Drawing Sheets

FIG. 1
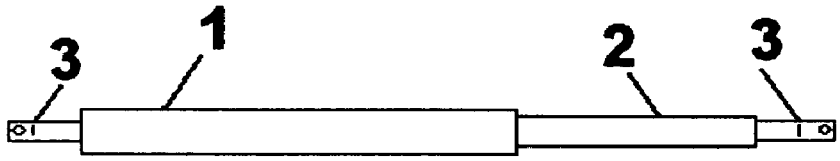
FIG. 1A
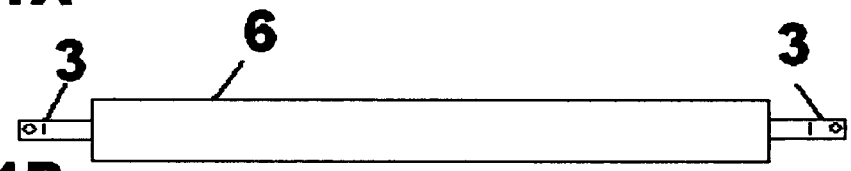
FIG. 1B
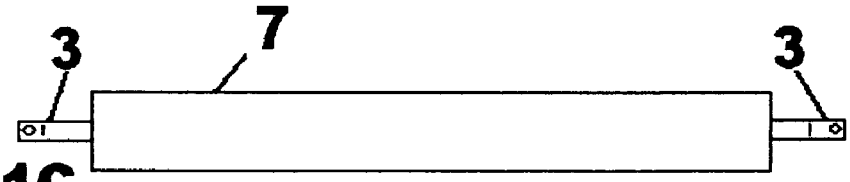
FIG. 1C
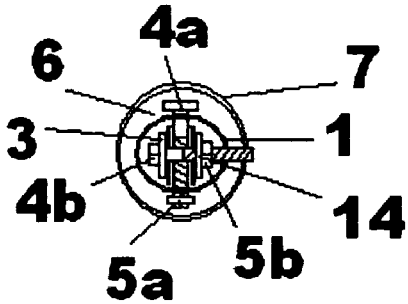
FIG. 1D
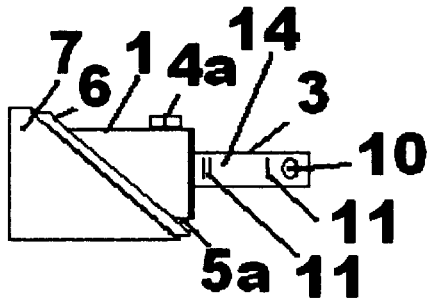
FIG. 1E FIG. 3
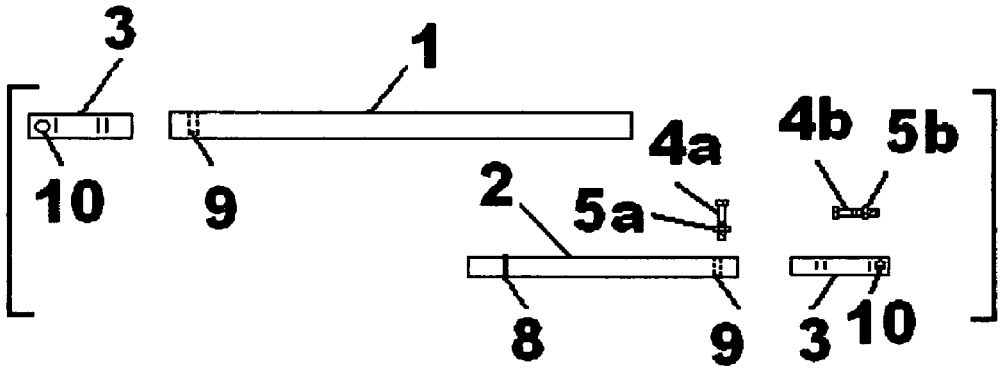
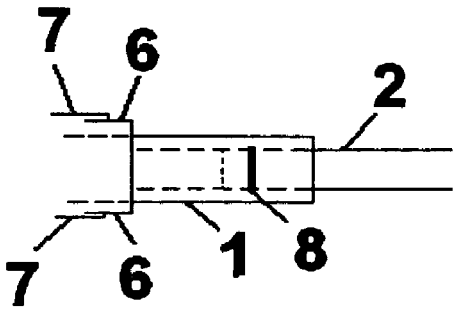
FIG. 3A
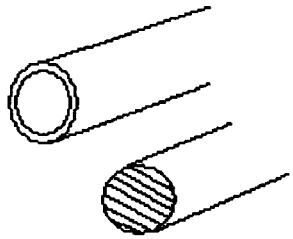
FIG. 3B FIG. 4
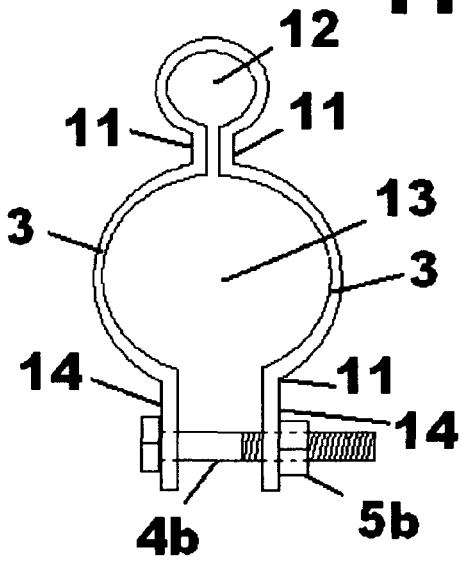
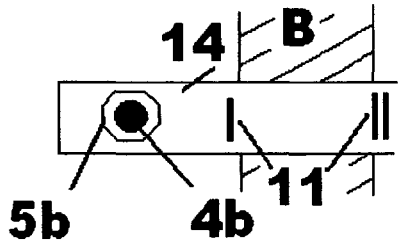
FIG. 4B
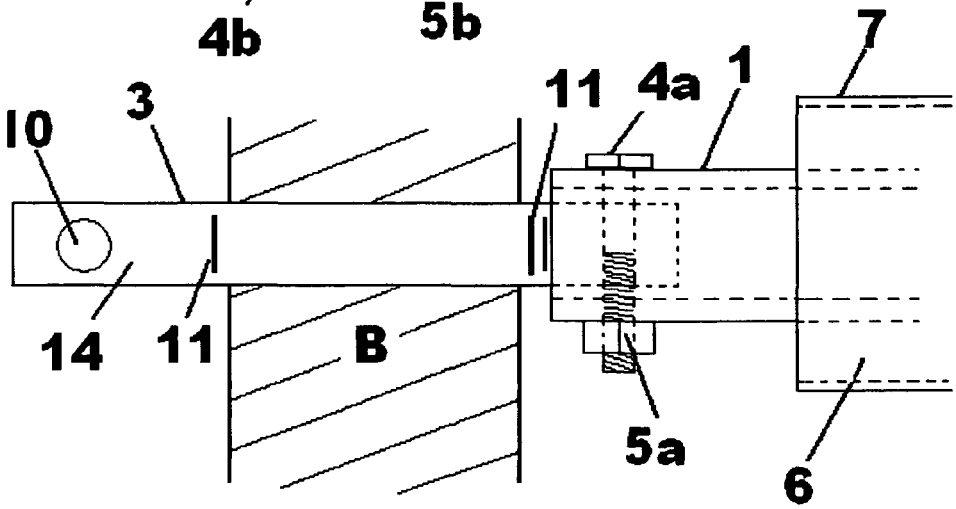
FIG. 4A

FIG. 6
FIG. 6A
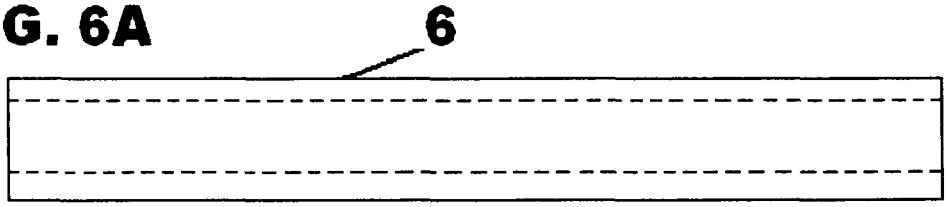
FIG. 6B
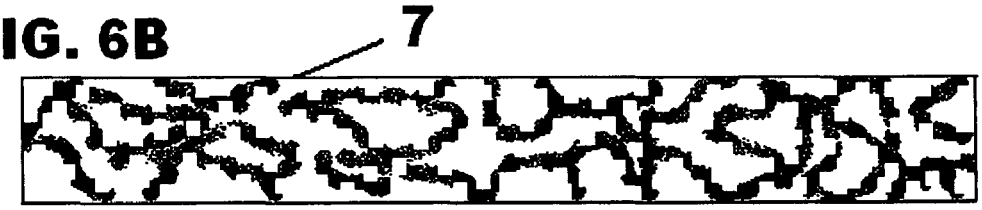
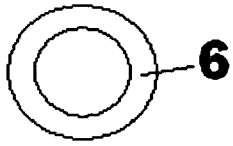
FIG. 6C
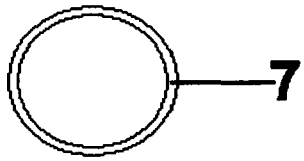
FIG. 6D
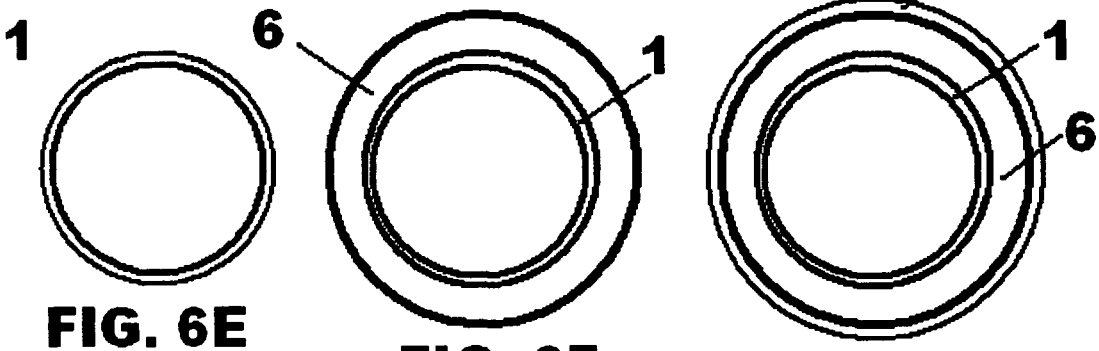
FIG. 6E
FIG. 6F
FIG. 6H

VEHICLE GUN STABILIZATION PLATFORM DEVICE

CROSS REFERENCE TO RELATED APPLICATIONS

This application claims the benefit of U.S. Provisional Patent Application No. 61/206,835, filed Feb. 6, 2009, the entire disclosure of which is considered as part of the disclosure of the present application and is hereby incorporated by reference herein.

STATEMENT REGARDING FEDERALLY SPONSORED RESEARCH OR DEVELOPMENT

N/A

BACKGROUND

1. Field of Invention

A telescoping tube article, this Vehicle Gun Stabilization Platform device comprises two cylindrical tubes or rods of predetermined lengths and diameters, capable of the smaller tube or rod being inserted and fitting within the cylindrical sleeve cavity of the larger tube or rod. This device incorporates, on the outward end of each telescoping cylindrical tube or rod, a horizontal axial hinge compression bracket coupling and locking device, open in a manner on the vertical end to grasp and secure the platform to a Utility Terrain Vehicles' (UTV) front or rear vertical roll over posts. This invention relates to the posture of a military, sporting firearm, or other appliance to minimize the effect of any involuntary body movement or vibration upon the firearms' sight plane providing the military or civilian target marksman or handicapped person a stable platform to rest the firearm during the sighting and trigger release process. This device will improve accuracy and subsequently military or civilian target scores and will be of special interest and assistance to disabled sportsmen confined to wheeled vehicle mobility or to the disabled or young sports person not capable of supporting the weight of a firearm. This device also has special application to military mobile shooting platforms or frames as a superior weapon support system related with sniper operations or military counter-terrorism engagements, cameras, or other devices upon which involuntary movement or vibration diminishes effectiveness.

2. Description of Prior Art

There have been many devices engineered and manufactured of tripod, bi-pod, and mono-pod nature for the vertical support of a military or sporting firearm. These devices do not address the support and stabilization of such a firearm or weapon during a military or civilian target shooting exercise while seated within an off road 4×4, off road UTV utility, or other vehicle or frame. This invention is a solution of a long felt and unresolved need; providing the military or civilian target shooter, disabled or young sports' person a stable horizontal sighting rest formed by a telescoping cylindrical sleeve and sliding insert tube. Horizontal axial hinge compression bracket couplings or horizontal locking anchors projecting from the outward horizontal distal end of each telescoping bar member mount on the front or rear vertical front roll over posts of such vehicles or frames, creating a solid horizontal plane upon which the firearm is rested allowing the seated marksman a vibration free rest. Traditionally, the point of impact on the military or civilian target is directly reflected in the ability of the marksman to hold a firearm absolutely still during a trigger release. A gun platform assists the marksman by allowing the marksman to place, support, rest, and fix the firearm to a much higher degree of desired stability reducing any negative influence of undesirable involuntary or collateral movement. This device will improve military or civilian target scores and will be of special interest and assistance to disabled sportsmen confined to wheeled vehicle mobility or to the disabled sports person or young sports person not capable of supporting the weight of a firearm. The advantage to the disabled is in the method of firearm operation. A gun platform allows the disabled sportsmen to support the firearm, sight in the firearm, and discharge the firearm using but a single arm, a mechanical weapon firing device, or with assistance, exclusively a single finger with little need for the support of traditional firearm body contact and posture.

Singularly there exists no prior art suggesting such a device. However, telescoping devices are known. As examples, U.S. Pat. No. 5,330,061, to Geltz, Jul. 19, 1994, describes a spinning shower rod mechanism with telescoping rods attaching to paralleling shower walls. U.S. Pat. No. 7,325,696, to Matthew and Alesi, Feb. 5, 2008, describes a multiple part adjustable auto clothes rod assembly attaching to the inside clothes hanger bracket of automobiles. There are ample other demonstrations of spring activated or cam locking telescoping cylindrical tubes and end anchoring devices that form shower curtain telescoping cylindrical tubes, window curtain telescoping cylindrical tubes, closet clothing telescoping cylindrical tubes, truck body cargo positioning load bars, automobile clothing cylindrical tubes, and other non-related applications of operation. None are defined as presenting a stabilization platform for weapon firing. None offer an outside encompassing circumference horizontal axial hinge compression bracket coupling means for distal end attachment to a vertical post. No reference is made to any application of such above devices as a supporting platform for a firearm during military or civilian target, sports, or other use. Therefore, this invention being a new principle of operation.

That being presented, this invention is designed as an improvement to the art, being a device consisting of two cylindrical tubes or rods or other shapes with nesting or telescoping capability, of predetermined lengths and diameters, capable of the smaller tube or rod being inserted and fitting within the cylindrical sleeve cavity of the larger tube. This device incorporates, on the outward end of each telescoping cylindrical tube or rod, a horizontal axial hinge compression bracket coupling or other locking device, open in a manner on the outward horizontal distal end to grasp and secure the platform by compression or other attachment method to the vehicles' front or rear vertical roll over posts. This invention provides a telescoping set of nesting cylindrical tubes or rods, which when extended and adjusted to the width of the distance between the vehicles' right and left front or rear vertical roll over bar posts, are then locked in this extended position of horizontal tension by means of horizontal axial hinge compression bracket couplings or other desirable locking devices; the horizontal telescoping cylindrical tubes are then by extension attached and locked to the vehicles' right and left front or rear vertical roll over bar posts by a compression, friction, grasping or locking device, horizontal axial hinge compression bracket coupling or other locking device producing such compression, friction or constriction by employment of horizontal or vertical constriction pressure, or pressure or friction from a wedge, nut bolt fastener, or other similar compression generator, ratchet lock, lever lock, bracket lock, hooks and catches, or any other effective locking closure or placement method upon each of the vehicles' vertical roll over posts.

This invention relates to the posture of a military or sporting firearm to minimize the effect of any involuntary body movement or other negative movement or vibration upon the firearms' sight plane providing the military or civilian target marksmen a stable platform to rest the firearm during the sighting and trigger release process. Many marksmen have been forever plagued with the inability to sight in a firearm free from involuntary bodily movements, thus greatly limiting the effectiveness of their firearm. This device thus resolves or significantly reduces such negative influences.

That being presented, this Vehicle Gun Stabilization Platform device is designed and accomplishes a significant and substantial improvement to the art, being a vehicle or frame mounted device relating to the posture of a military or sporting firearm or other weapon or appliance to minimize the effect of any involuntary body movement or other vibration upon the firearms' or weapons' sight plane providing the military or civilian target marksman a stable platform to rest or support the firearm during the sighting and trigger release process.

The prior art references does not contain any suggestion, express or implied, that they be combined, or that they be combined in any manner.

BRIEF SUMMARY OF THE INVENTION

The present invention is directed to be of two predetermined length and diameter telescoping tubular cylindrical tubes or rods, on the outward end of these telescoping cylindrical tubes, a horizontal axial hinge compression bracket coupling or other locking device, open on the outward horizontal distal end to grasp and secure the platform to the vehicles' front or rear vertical roll over posts. Further, the invention provides a telescoping set of cylindrical tubes or rods, which when extended and adjusted to the width of the distance between the vehicles right and left front or rear vertical roll over bar support, are then attached and locked to the vehicles' right and left front or rear vertical roll over bar posts by fixture of a horizontal axial hinge compression bracket coupling or other locking device, the device producing such compression, friction or mounting by means of compression, friction, constriction or wedge, nut and bolt or other similar compression generator, ratchet lock, lever lock, bracket lock, hooks and catches, or any other closure method, to secure the device in a stable horizontal manner upon each of the vehicles' vertical roll over posts.

The utility of this invention allows marksmen the advantage of supporting, stabilizing, and discharging their firearm from a gun platform free of vibration and free of the negative interference of involuntary bodily or collateral movement. The accuracy and military or civilian target score of the marksman is greatly improved.

The present invention incorporates two cylindrical tubes or rods of predetermined lengths and diameters, capable of the smaller tube or rod being inserted and fitting within the cylindrical sleeve cavity of the larger tube, both tubes encased within a foam sleeve and sheathed within a fabric cover. This device locks upon the vehicles existing right and left roll over posts, by the incorporation, on the outward end of each telescoping cylindrical tube, of a horizontal axial hinge compression bracket coupling or other locking device, open on the outward horizontal distal end to grasp and secure the platform to the vehicles' vertical roll over posts. The invention provides a telescoping set of nested cylindrical tubes, which when extended and adjusted to the width of the distance between the vehicles right and left front or rear vertical roll over bar posts, becoming locked in this extended position by means of horizontal axial hinge compression bracket coupling(s) or other desirable locking devices; attaching and locking to the vehicles' right and left front or rear vertical roll over bar posts by a compression, friction, pressure, grasping, wedging of a bracket coupling locking device, a horizontal axial hinge compression bracket coupling or locking device producing such compression, friction, pressure, or constriction by employment of compression, friction, constriction pressure, wedge, nut bolt or other similar compression generator, ratchet lock, lever lock, bracket lock, hooks and catches, or any other effective closure method upon each of the vehicles' vertical roll over posts, forming a stable horizontal rest. Each component of the device and each attachment may be of a singular shaped and formed piece or multi piece metal, plastics, foam, fabric, rubber, molded synthetic, resin material construction, or other materials, or of stamped, pressed, molded, extruded, tooling, die machine or cast manufactured metal components, or any combination of metal, plastic(s), molded synthetic or resin material, extruded, tooled, die, and machined or cast components, that assemble to create the gun platform frame, locking system, and vertical roll over post attachment couplings. However, those skilled in the art will appreciate that this vehicle gun stabilization platform device and telescoping frame can also have other configurations as well.

BRIEF DESCRIPTION OF SEVERAL VIEWS OF THE DRAWINGS

The objects of the invention are achieved as set forth in the illustrative embodiments shown in the drawings, which form a part of the specification.

FIG. 1A to FIG. 1E are perspective views of embodiments; FIG. 1A the nested tubes and distal end bracket coupling; FIG. 1B the nested tubes nested within a anti-vibration foam cushion sleeve which may or may not be of concentric shape; FIG. 1C the cushion jacketed tubes nested within a foam sleeve and sheathed within a fabric cover; FIG. 1D the placement position of the axial nut and bolt, the placement position of the horizontal compression nut and bolt; and FIG. 1E the order of tube and bracket nesting and component sheathing.

FIG. 3 is a perspective bracketed view of the mounting, nesting, and compression components of the device. FIG. 3A is a perspective positioning view of the configuration of the major nesting and sheathing components of the device. FIG. 3B is illustrative of the possible variation of smaller tube sleeve cores.

FIG. 4 is a perspective overview of the platforms' horizontal axial hinge compression bracket coupling attachment; FIG. 4A is a perspective side view of the telescoping end of cylindrical tube with a horizontal axial hinge compression bracket coupling positioning and attachment in relationship to the vehicle's vertical roll over post; FIG. 4B is a perspective view of the compression nut and bolt in the mounting position of a horizontal axial hinge compression bracket coupling.

FIG. 6 is a perspective view of the embodiments; a side view of the anti-vibration foam cushion sleeve FIG. 6A and a side view of the fabric cover FIG. 6B; FIG. 6C is an end view of the anti-vibration foam cushion sleeve; FIG. 6D is an end view of the fabric cover; FIG. 6E is an end view of the metal tube; FIG. 6F is an end view of the anti-vibration foam cushion sleeve upon the metal tube; and FIG. 6H is an end view of the fabric cover sleeve upon the anti-vibration foam cushion sleeve encasing the metal tube.

Corresponding reference characters indicate corresponding parts throughout the several views of the drawings.

DETAILED DESCRIPTION OF THE INVENTION

Figure 2:
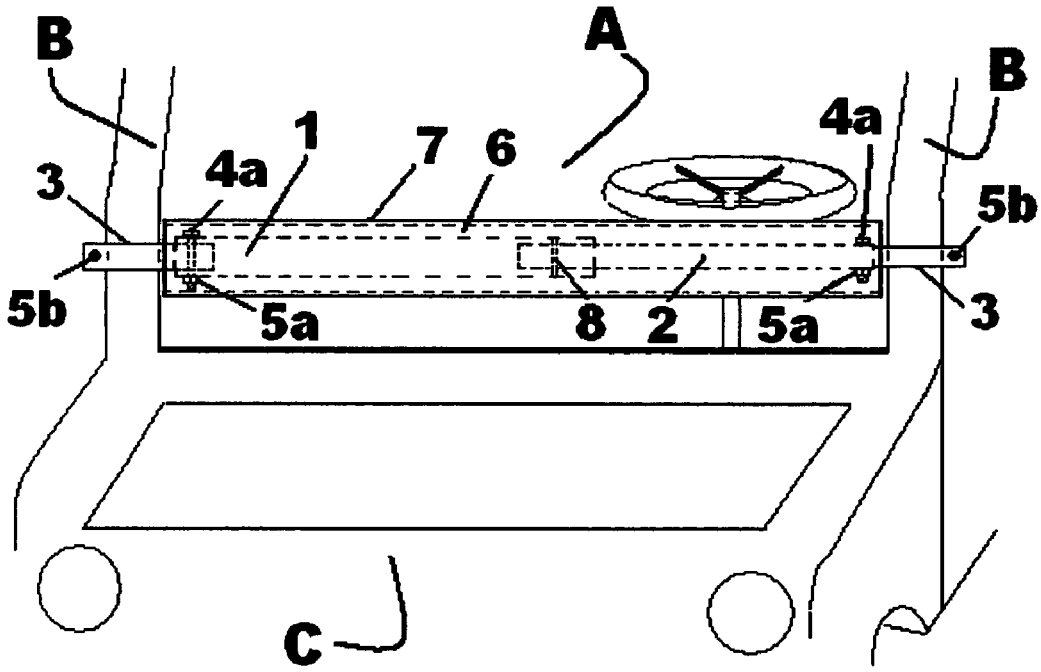
FIG. 2 is a perspective view of the horizontal plane and features of the telescoping platform device mounted to the vehicles' vertical roll over posts. The desirability of such a fixed stabilization device is obvious to the marksman.

The following detailed description illustrates the invention by way of example and not by way of limitation. This description will clearly enable one skilled in the art to make and use the invention, describes several embodiments, adaptations, variations, and uses of this invention, including what I presently believe is the best mode of carrying out this invention. As various changes could be made in the above construction without departing from the scope of the invention, it is intended that all matter contained in the above description or shown in the accompanying drawings shall be interpreted as illustrative and not in a limiting sense.

This invention is designed as being a device consisting of two cylindrical tubes or rods of predetermined lengths and diameters, capable of the smaller tube or rod being inserted and fitting within the cylindrical sleeve cavity of the larger tube. This device incorporates, on each end of the telescoping cylindrical tubes, a horizontal axial hinge compression bracket coupling or other locking device, open on the outward horizontal distal end to grasp and secure the platform to the vehicles' vertical roll over posts. The invention provides a telescoping and nesting set of cylindrical tubes or rods, which when extended and adjusted to the width of the distance between the vehicles right and left front or rear vertical roll over bar posts, are then locked in this extended position by means of a horizontal axial hinge compression bracket coupling(s) or other desirable locking device; the horizontal telescoping cylindrical tubes becoming attached and locked to the vehicles' right and left front or rear vertical roll over bar posts by means of a compression, friction, pressure, grasping, wedging, bracket coupling locking device, horizontal axial hinge compression bracket coupling or other locking device producing such compression, friction or constriction by employment of compression, constriction, pressure, or wedge, nut bolt or other similar compression generator, ratchet lock, lever lock, bracket lock, hooks and catches, or any other effective closure and attachment method upon each of the vehicles' vertical posts. However, those skilled in the art will appreciate that this device can have other configurations and attachment devices as well.

Referring to the drawings, FIG. 1, attachment A details the invention, Vehicle Gun Stabilization Device A in component segments indicative of assembly order. FIG. 1A depicts a larger cylindrical tube 1 nesting a smaller diameter cylindrical tube 2 attached to a horizontal axial hinge compression bracket coupling(s) 3 at the terminal end of larger cylindrical tube sleeve 1 and smaller cylindrical tube 2. FIG. 1B presents an anti-vibration foam cushion sleeve 6 encasing cylindrical tube sleeve 1 and cylindrical tube 2. FIG. 1C presents fabric cover 7 encasing anti-vibration foam cushion sleeve 6 cylindrical tube sleeve 1 and cylindrical tube 2. FIG. 1D depicts a distal end perspective of the position and relationship of horizontal axial hinge compression bracket coupling 3, vertical axial nut 5*a*, vertical axial pivotal bolt 4*a*, horizontal compression nut 5*b* and horizontal compression bolt 4*b* attached to the terminal end of tube, either 1 or 2, further defining the encompassment of tubes 1 and 2 by cushion sleeve 6 and fabric cover 7. FIG. 1E presents a component side view of tube, either 1 or 2, encased within fabric cover 7, and cushion sleeve 6 with horizontal axial hinge compression bracket coupling 3 securing to the vehicle roll over post B by application of compression pressure of horizontal compression nut 5*b* (not shown) and horizontal compression bolt 4*b* (not shown) within the horizontal bolt channel 10 of compression arm 14.

Referring to the drawings, FIG. 2, attachment A details the invention mounted horizontally within and locking or affixing to the vertical roll over posts B on the body frame of the off road, UTV utility vehicle C. The illustration depicts the horizontal position, which can be further horizontally adjusted to either a higher or lower plane to compensate for the marksmans' physical stature. FIG. 2, attachment A depicts the point of horizontal stabilization of the telescoping nesting cylindrical tubes or rods 1, 2 by the mounting of horizontal axial hinge compression bracket couplings 3 or other coupling method to the distal end of tube 1 and tube 2. FIG. 2 provides illustration of the horizontal rigidity plane establishing the stabilization effect this invention has for compensating for involuntary movement, restricting and limiting such movement to a negligible degree of vertical and horizontal sight drift. FIG. 2 perspective overall view shows a view of fabric cover 7 encasing foam cushion sleeve 6 sheathing both telescoping larger tube 1 and telescoping smaller tube 2, the placement of the rubber or synthetic material anti-vibration annular O-ring 8, a vertical axial nut 5*a*, a vertical axial pivotal bolt 4*a*, horizontal axial hinge compression bracket couplings 3 attaching to the distal ends of tube 1 and 2 by vertical axial nut 5*a*, vertical axial pivotal bolt 4*a*, and the attachment and mounting of the horizontal axial hinge compression bracket coupling(s) 3 by a clockwise tightening motion of vertical axial nut 5*a* and stationary resistance of vertical axial pivotal bolt 4*a*, a similar compressive action being applied to horizontal compression nut 5*b* and horizontal compression bolt 4*b*.

Referring to FIG. 3, attachment A of the present invention comprising two main tubular cylindrical tubes or rods 1, 2 which nest by means of a telescoping nature with the smaller cylindrical tube or rod 2 being inserted and nesting within the larger cylindrical tube or rod 1 which command a movement or projection of a telescoping nature. A rubber, synthetic, or other material anti-vibration annular O-ring 8 is affixed upon smaller tube 2, both then being inserted into the body of larger tube 1. The end of each tube or rod 1, 2 is attached to the body of horizontal axial hinge compression bracket coupling(s) 3 by insertion and placement of a horizontal axial hinge compression bracket's vertical axial pivot collar ring 12 (not shown) into the distal end of tube 1, 2 and attached to tube 1 and 2 with the placement of a vertical axial nut 5*a*, vertical axial pivotal bolt 4*a* of predetermined diameter and length through axial bolt channel 9. FIG. 3 depicts horizontal axial hinge compression bracket coupling 3 aligning on a plane with tube 1 and 2 depicting the placement of vertical axial nut 5*a* and vertical axial pivotal bolt 4*a* the placement and fixing of the telescoping tubes or rods 1, 2 in a manner to allow for the adaptability of the horizontal extension to compensate for the variants of frame width dimensions of models and vehicle manufacturers. The placement and fixing of horizontal hinge compression bracket coupling 3 attaching to the vehicles roll over posts B (not shown) is achieved by insertion and clockwise tightening of horizontal compression nut 5*b* upon horizontal compression bolt 4*b* through the bolt channel 10. FIG. 3A presents the smaller diameter tube or rod 2 nested within the sleeve of the larger diameter tube or rod 1 depicting the component assembly of larger tube 1, smaller tube 2, annular ring 8, foam cushion sleeve 6, and fabric cover sleeve 7. FIG. 3B presents a limited example of acceptable form variables in smaller diameter tube 2, being a hollow tube or solid rod.

FIG. 4, Attachment A presents a top view of horizontal axial hinge compression bracket coupling 3, bracket vertical axial pivot collar ring 12, compression bracket shape forming crimp(s) 11, bracket horizontal annular pivot collar post turret hub 13, horizontal compression nut 5*b* and horizontal compression bolt 4*b* fixed within bolt channel 10 (not shown) and compression arm(s) 14. FIG. 4A presents a side view of fabric sleeve 7, foam cushion sleeve 6, larger tube 1, vertical axial nut 5*a*, vertical axial pivotal bolt 4*a*, horizontal axial hinge compression bracket coupling 3, crimp(s) 11, arm(s) 14, vehicle vertical roll over post B, and bolt channel 10. FIG. 4B presents horizontal compression nut 5*b* and horizontal compression bolt 4*b* attached to horizontal axial hinge compression bracket coupling 3, and compression arm 14.

Figure 5:
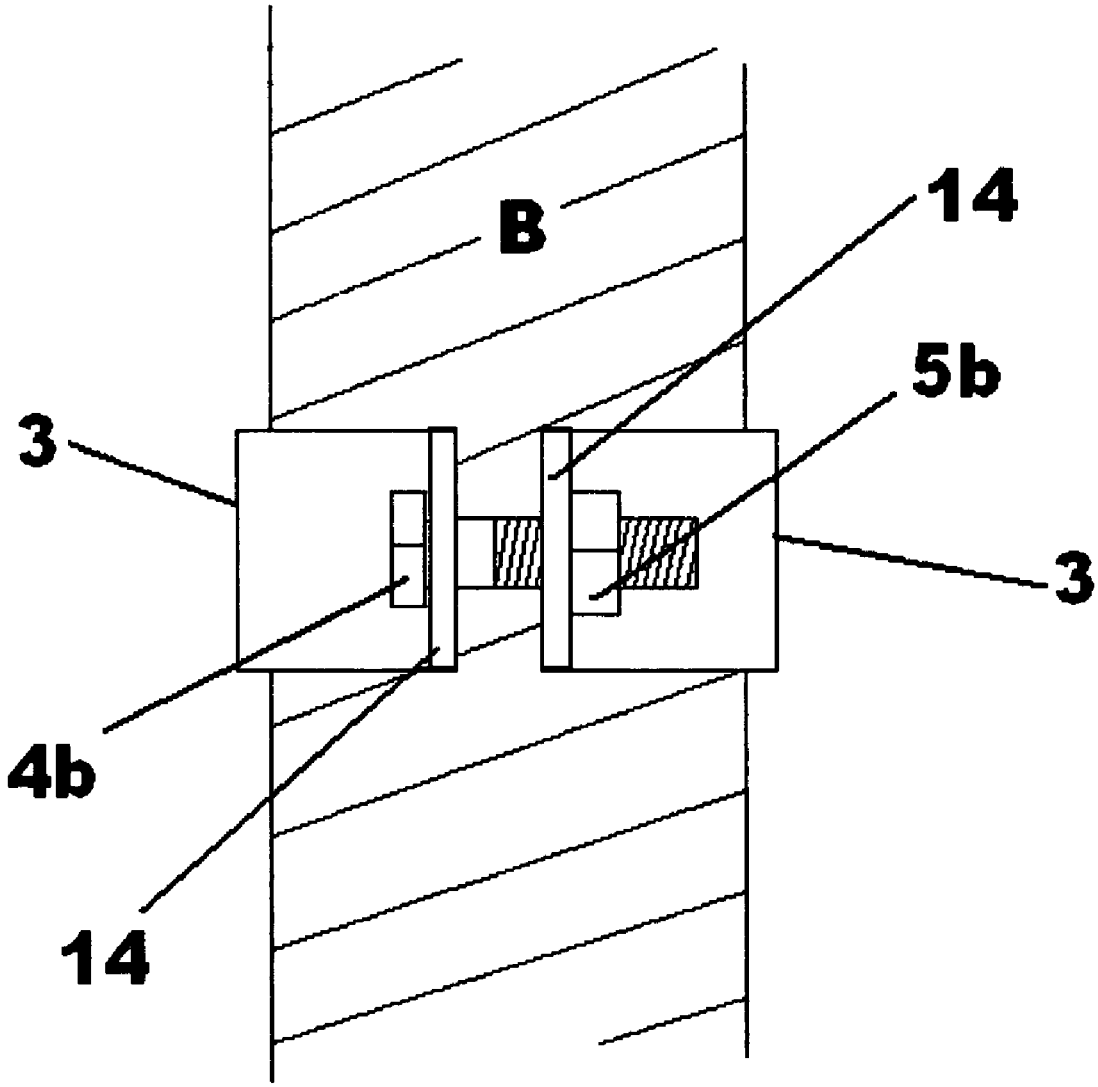
FIG. 5 is a perspective side view of the compression nut and bolt fixed within a horizontal axial hinge compression bracket coupling in a mounted position to the vehicle roll over post.

FIG. 5, Attachment A presents an end perspective view of horizontal axial hinge compression bracket coupling 3, compressed by a clockwise tightening motion of horizontal compression nut 5*b* and stationary counter pressure on horizontal compression bolt 4*b* and such action upon horizontal compression nut 5*b* and horizontal compression bolt 4*b* compressing and fixing arm 14 to the vertical vehicle roll over bar B.

FIG. 6, Attachment A FIG. 6A presents foam cushion sleeve 6. FIG. 6B presents fabric sleeve 7 in a camouflage pattern. FIG. 6C depicts an end view of foam cushion sleeve 6. FIG. 6D presents an end view of fabric cover 7. FIG. 6E presents an end view of larger tube 1. FIG. 6F depicts an end view of foam cushion sleeve 6 sheathing larger tube 1. FIG. H presents an end view of fabric cover 7 sheathing foam cushion sleeve 6.

A marksmans' ability to support a firearm in either an "offhand" position, while maintaining an absolute zero on the intended target, subjects such "body platforms" to the virtual influence of any collateral or involuntary aim spoiling movement, horizontal or vertical, however infinitesimal, including the negative effect of fatigue or gravity transferred upon the firearm which is compensated by the rigidness of the telescoping gun platform when mounted within the frame of a off road 4×4, off road UTV, or other utility vehicle or frame. A marksman' firearm when rested upon the telescoping horizontal plane of this device is not subjected to the significant and negative influences of breathing rate, heart beat, mild physical tremors, other involuntary bodily motions, vibrations, wind movements, physical disability, or other direct or indirect disturbances. This invention will increase both the satisfaction and the military or civilian target scores of marksmen and disabled marksmen using this device.

In view of the above, it will be seen that the several objects and advantages of the present invention have been achieved and other advantageous results have been obtained.

Having thus described the invention, what is claimed to be secured by Letters Patent is:

1. A telescoping tube apparatus, for attachment to a plurality of opposing vehicle vertical roll bar members of an all terrain vehicle, supporting a firearm and creating a longitudinal sight plane comprising:

a. a first tubular member of predetermined size having an exterior end and an interior end;

b. a second tubular member of predetermined size having an exterior end and an interior end; said second tubular member interior end being telescopically received by said first tubular member;

c. an annular O-ring, seated upon the interior end of the second tubular member;

d. a horizontal axial hinge compression bracket coupling comprising a horizontally mounted female, open end, hinge bracket clamp for securing to the exterior end of said telescoping tubes in a fixed horizontal position to produce a horizontal frame assembly wherein said horizontal axial hinge compression bracket coupling being attached to a telescoping tube end by means of compression;

e. a horizontal axial hinge compression bracket coupling for securing the exterior ends of said telescoping tubes in fixed positions to produce a horizontal frame assembly wherein said horizontal axial hinge compression bracket coupling is attached to a vehicle vertical member by means of compression;

f. an elongated bolt channel passage opening at opposing ends in first tubular member's top and bottom exterior end and an elongated bolt channel passage opening at opposing ends in the second tubular member's top and bottom exterior end creating an elongated bolt channel passage for a tightening device consisting of a bolt, and nut;

g. a mounting means for the exterior end of said first tubular member and mounting means for the exterior end of said second tubular member for mounting said first and second tubular member to a horizontal axial hinge compression bracket coupling;

h. a mounting means for the exterior end of said first tubular member's horizontal axial hinge compression bracket coupling and mounting means for the exterior end of said second tubular member's horizontal axial hinge compression bracket coupling for mounting said first and second tubular member horizontal axial hinge compression bracket coupling onto a vehicle's vertical member.

2. The telescoping tube apparatus of claim 1, further including a means for attaching a mounting mechanism to said first tubular member's exterior end and said second tubular member's exterior end comprising:

a. a horizontal axial hinge compression bracket coupling nested within, attaching to and extending from said first and second tubular member's exterior end;

b. a bolt comprising a hexagonal head from which coaxially extends an integral shank having a transverse polygonal cross section from which coaxially extends a threaded cylindrical portion and an outside threaded shaft and an internally threaded nut cooperating with said threaded portion;

c. said bolt assembly and said horizontal axial hinge compression bracket couplings and their respective parts being arranged in series, a inner face of the bolt head contacts the surface of the elongated passage opening at opposite ends in said first tubular member's top and bottom exterior end and an elongated passage opening at opposite ends in said second tubular member's top and bottom exterior end, a polygonal shank of said bolt extends through the corresponding elongated passage, a cylindrical threaded portion of said bolt extends through a deformable member of the a horizontally axial hinge compression bracket coupling, said cylindrical threaded portion of said bolt shaft extends through being threaded on the corresponding threaded cylindrical portion of said nut.

3. The telescoping tube apparatus of claim 1, further including a means for attaching said telescoping tube end, a horizontal axial hinge compression bracket coupling to a plurality of opposing vehicle vertical members comprising:

a. an attached horizontal axial hinge compression bracket coupling nested within and extending from the first and second tubular member's exterior end;

b. a bolt assembly comprising a head with a flat inner surface from which coaxially extends an integral shank having a transverse polygonal cross section from which coaxially extends a threaded cylindrical portion and an outside threaded shaft and an internally threaded nut cooperating with said threaded portion;

c. said bolt assembly and said two horizontally mounted axial hinge compression bracket coupling members and their respective parts being arranged in series, the inner face of the bolt head contacts the surface of an elongated bolt channel passage opening at opposite ends in the first tubular member's top and bottom exterior end and an elongated bolt channel passage opening at opposite ends in the second tubular member's top and bottom exterior end, a polygonal shank of the bolt extends through the corresponding elongated bolt channel passage, the cylindrical threaded portion of said bolt extends through the deformable members of the horizontal axial hinge compression bracket coupling cylindrical threaded portion of the bolt shaft extends through being threaded on the corresponding threaded cylindrical portion of said nut.

4. The telescoping tube apparatus of claim 1, said telescoping and extending action of said second tubular member from within said first tubular member whereby allowing adjustment of the overall length of said telescoping means to adapt and conform to varying mesial distances of manufacturing model vertical frame member specifications by combining compression of said horizontal axial hinge compression bracket coupling's bolts and nuts positioned at the exterior end of first tubular member and second tubular member.

5. The telescoping tube apparatus of claim 1, wherein said invention establishes a horizontal firearm sighting plane by attachment of said device to opposing vehicle vertical members whereby a human can aim, track, and engage stationary and mobile targets in a convenient, conventional, and safe manner.

* * * * *